US005184409A

United States Patent [19]

Brown

[11] Patent Number: 5,184,409

[45] Date of Patent: Feb. 9, 1993

[54] ORTHOTIC INSERT AND METHOD OF MAKING OF THE SAME

[75] Inventor: Dennis N. Brown, Blaine, Wash.

[73] Assignee: Northwest Podiatric Laboratory, Inc., Blaine, Wash.

[21] Appl. No.: 714,983

[22] Filed: Jun. 14, 1991

Related U.S. Application Data

[60] Continuation of Ser. No. 636,573, Jan. 2, 1991, abandoned, which is a continuation of Ser. No. 565,887, Aug. 8, 1990, abandoned, which is a continuation of Ser. No. 450,610, Dec. 13, 1989, abandoned, which is a continuation of Ser. No. 326,288, Mar. 20, 1989, abandoned, which is a continuation of Ser. No. 196,147, May 19, 1988, abandoned, which is a continuation of Ser. No. 88,127, Aug. 21, 1988, abandoned, which is a continuation of Ser. No. 870,123, Jun. 3, 1986, abandoned, which is a division of Ser. No. 766,049, Aug. 15, 1985, abandoned, which is a continuation-in-part of Ser. No. 643,823, Aug. 24, 1984, abandoned.

[51] Int. Cl.[5] ..... A43B 13/38; A43B 13/40

[52] U.S. Cl. ..... 36/44; 36/71; 36/173

[58] Field of Search ..... 36/44, 43, 71, 143, 36/144, 172, 173, 174, 178, 180, 181, 166; 128/581

[56] References Cited

U.S. PATENT DOCUMENTS

| | | | |
|---|---|---|---|
| Re. 33,648 | 7/1991 | Brown | 36/44 |
| 2,502,774 | 4/1950 | Alianiello | 36/44 |
| 2,982,193 | 3/1960 | Kristan | 36/44 |
| 3,244,649 | 4/1966 | Levitt | 36/43 |
| 3,601,908 | 8/1971 | Gilkerson | 36/44 |
| 3,859,740 | 1/1975 | Kemp | 36/71 |
| 4,168,585 | 9/1979 | Gleichner | 36/71 |
| 4,360,027 | 11/1982 | Friedlander et al. | 36/44 |
| 4,435,910 | 3/1984 | Marc | 36/44 |
| 4,513,518 | 4/1985 | Jalbert et al. | 36/43 |
| 4,530,173 | 7/1985 | Jesinsky, Jr. | 36/173 |
| 4,586,273 | 5/1986 | Chapnick | 36/44 |
| 4,597,196 | 7/1986 | Brown | 36/44 |

FOREIGN PATENT DOCUMENTS

| | | | |
|---|---|---|---|
| 569571 | 8/1958 | Belgium | 36/44 |
| 452492 | 5/1935 | United Kingdom | 36/44 |
| 1063039 | 3/1967 | United Kingdom | 36/71 |
| 2124473 | 2/1984 | United Kingdom | 36/43 |

*Primary Examiner*—Steven N. Meyers
*Attorney, Agent, or Firm*—Hughes & Multer

[57] ABSTRACT

An orthotic appliance adapted to be placed in an article of footwear, the orthotic including a first upper, relatively flexible blank portion and an underlying, relatively rigid cap portion. The blank portion has a longitudinally-extending zone of disparate resiliency relative to first and second side areas of the blank; the zone of disparate resiliency deforms downwardly raeltive to the side areas as the foot begins to bear weight, so that the side areas cradle the foot and urge it into a neutral position as the foot transitions from heel strike to mid-gait. A relatively resilient pad portion and a moldable insert are positioned intermediate the blank and cap portions. The zone of disparate resiliency may be formed by a recess in the bottom side of the blank, and the pad may be complementally formed to fit into this and so modify the zone of disparate resiliency.

15 Claims, 12 Drawing Sheets

ORTHOTIC INSERT AND METHOD OF MAKING OF THE SAME

This is a continuation of copending application Ser. No. 07/636,573 filed on Jan. 2, 1991 which is a continuation of Ser. No. 07/565,887 filed on Aug. 8, 1990; which is a continuation of Ser. No. 07/450,610 filed on Dec. 13, 1989; which is a continuation of Ser. No. 07/326,288 filed on Mar. 20, 1989; which is a continuation of Ser. No. 07/196,147 filed on May 19, 1988; which is a continuation of Ser. No. 07/088,127 filed on Aug. 21, 1988; which is a continuation of Ser. No. 07/870,123 filed on Jun. 3, 1986; which is a division of Ser. No. 06/766,049 filed on Aug. 15, 1985; which is a continuation-in-part of Ser. No. 06/643,823 filed on Aug. 24, 1984.

BACKGROUND OF THE INVENTION

1. Field of the Invention

The present invention relates to an orthotic insert, and more particularly for such an insert which is particularly adapted to function effectively throughout the gait cycle experienced in the common walking motion or in the common jogging or running motion.

2. Background Art

An orthotic insert can be either soft or hard. A hand insert is a substantially rigid member, desirably having a relatively thin vertical thickness dimension and extending from the calcaneus area of the foot (the heel portion) to at least the metatarsal head area of the foot (i.e. that area at the "ball" of the foot). In general, the purpose of a rigid orthotic (sometimes called a functional orthotic) is to first position, and then to control the movements of, the midtarsal and subtalar joints during the gait cycle which the body goes through in walking and running, and also possibly for other movements.

It is believed that a clearer understanding of the background of the present invention will be achieved by first discussing generally: a) the main components or parts of the human leg and foot and how these function relative to one another; b) the gait cycle which a person goes through in a normal walking motion; and c) the intended function of a rigid orthotic in optimizing the coordinated operation of the person's foot and leg throughout the gait cycle.

For convenience, these various topics will be discussed under appropriate subheadings.

a) The Main Components or Parts of the Human Leg and Foot and How These Function Relative to One Another With reference to FIGS. 1-3, there is shown a typical human foot 10, and (in FIGS. 2 and 3) the lower part 12 of the leg 14. The two lower bones of the leg 14 are the tibia 16 and the fibula 18. Below the tibia 16 and fibula 18, there is the talus 20 (i.e. the "ankle bone"). Positioned below and rearwardly of the talus 20 is the calcaneus 22 (i.e. the heel bone). Positioned moderately below and forward of the talus 20 are the navicular 24 and the cuboid 26. Extending forwardly from the navicular 24 are the three cuneform bones 28. Extending forwardly from the cuneform bones 28 and from the cuboid 26 are the five metatarsals 30. Forwardly of the metatarsals 30 are the phalanges 32 which make up the five toes 34.

The movement of the talus 20 relative to the tibia 16 and fibula 18 is such that it enables the entire foot to be articulated upwardly and downwardly (in the motion of raising or lowering the forward part of the foot). However, the talus 20 is connected to the tibia 16 and fibula 18 in such a way that when the entire leg 14 is rotated about its vertical axis (i.e. the axis extending the length of the leg), the talus 20 rotates with the leg 14.

With regard to the relationship of the talus 20 to the calcaneus 22, these move relative to one another about what is called the "subtalar joint" indicated at 36. The subtalar joint 36 can be described generally as a hinge joint about which the talus 20 and calcaneus 22 articulate relative to one another. The hinge axis extends upwardly and forwardly at an angle of about 42° from the horizontal, and also slants forwardly and inwardly at a moderate angle (e.g. about 16° from a straightforward direction). There is also the midtarsal joint 38, and this will be discussed later.

To explain further the hinge motion of the subtalar joint 36, reference is now made to FIGS. 4*a* and 4*b*. The talus 20 can be considered as a vertical board 40, and the calcaneus 22 as a horizontally extending board 42, these being hinge connected to one another along a diagonal hinge line 44, with this hinge line corresponding to the subtalar joint 36. It can be seen with reference to FIG. 4 *a* that as the talus 20 is rotated inwardly about its vertical axis (i.e. the front part of the leg being rotated toward the center of the person's body), there is a corresponding rotation of the calcaneus 22 (i.e. the horizontal board 42) about a horizontal axis. It can be seen in FIG. 4*b* that an opposite (i.e. outward) rotation of the talus 20 (i.e. the vertical board 40) causes a corresponding rotation of the calcaneus 22 (i.e. the horizontal board 42) in the opposite direction to that shown in FIG. 4*a*.

This motion described with reference to FIGS. 4*a* and 4*b* above is critical in the gait cycle (i.e. the cycle through which the person goes in normal walking or running motion), and this will be discussed more fully below.

With regard to the midtarsal joint 38, this is in reality composed of two separate joints, the talo-navicular and the calcaneal-cuboid. It is a complex joint, and no attempt will be made to illustrate or recreate its motion accurately. Instead, there will be presented a somewhat simplified explanation of its function as it relates to the present invention.

The main concern, relative to the midtarsal joint, is not the precise relative motion of the parts of the foot that make up this joint, but rather the locking and unlocking procedure of the midtarsal joint which occurs when there is an outward motion of the leg 14 and the talus 20 (outward motion meaning the rotation of the leg 14 about the vertical axis of the leg 14 in a manner that the knee moves outwardly from the person's body), and an opposite inward motion, respectively. When the leg 14 rotates inwardly, the midtarsal joint 38 unlocks so that the portion of the foot 10 forwardly of the joint 38 (i.e. the midfoot 45) is flexible, this being the "pronated" position of the foot. On the other hand, when the leg 14 and talus 20 rotate outwardly, the foot is said to be "supinated" so that the midtarsal joint 38 is locked and the midfoot 45 essentially becomes a part of a rigid lever. In actuality, the midfoot 45 never becomes totally rigid, so that even in the totally supinated position, there is some degree of flexibility in the midfoot 45.

This function of the midtarsal joint will now be explained relative to FIGS. 5*a* and 5*b*. It can be seen that FIGS. 5*a-b* are generally the same as FIGS. 4*a-b*, except that a forward board member 46 is shown to represent the midfoot 45, this member 46 having a downward taper in a forward direction, and also a lower horizontal plate portion 48. This plate portion 48 is intended to represent that the plantar surface (i.e. the lower support surface) of the midfoot 45 engages the underlying support surface in a manner so as to remain generally horizontal to the support surface.

It can be seen that when the two board members 40 and 42 are in the pronated position of FIG. 5*a*, the metatarsal joint represented at 5 in FIGS. 5*a–b* is in a first position which will be presumed to be an unlocked position. In the unlocked position of FIG. 5*a*, the member 46 is not rigid with the horizontal member 42, and the forward member 46 can flex upwardly relative to the horizontal member 42. (This is the pronated position of for foot 10.) However, in the position of FIG. 5*b*, the board members 46 and 42 will be presumed to be locked to one another so that the members 42 and 46 form a unitary lever. For ease of illustration, no attempt has been made to illustrate physically the unlocking relationship of FIG. 5*a*, and the locking relationship of FIG. 5*b*. Rather, the illustrations of FIGS. 5*a–b* are to show the relative movement of these components, and the locking and unlocking mechanism is presumed to exist.

b) The Gate Cycle Which the Person Goes Through in a Normal Walking Motion

Reference is first made to FIGS. 6*a* and 6*b*. As illustrated in the graph of FIG. 6*a*, during the normal walking motion, the hip (i.e. the pelvis) moves on a transverse plane, and this movement in the gait cycle is illustrated in FIG. 6*b*. Also, the femur (i.e. the leg bone between the knee joint and the hip) and the tibia rotate about an axis parallel to the length of the person's leg. (It is this rotation of the leg about its vertical axis which in large part causes the pronating and supinating of the foot during the gait cycle, and this will be explained in more detail below.)

There is also the flexing and extension of the knee, as illustrated in the five figures immediately below the graph of FIG. 6*a*. Further, there is the flexing and extension of the ankle joint. At the beginning of the gait cycle, the heel of the forwardly positioned leg strikes the ground, after which the forward part of the foot rotates downwardly into ground engagement. After the leg continues through its walking motion to extend rearwardly during the gait cycle, the person pushes off from the ball of the foot as the other leg comes into ground engagement.

The motions described above are in large part generally apparent by a relatively casual observation of a person walking. However, the motion which is generally overlooked by those not familiar with the gait cycle is the inward and outward rotation of the leg about its lengthwise axis to cause the pronating an supinating of the foot through the gait cycle. This will be described relative to FIG. 7*a* and FIG. 7*b*.

When the leg is swung forwardly and makes initial ground contact, at the moment of ground contact the leg is rotated moderately to the outside (i.e. the knee of the leg is at a more outward position away from the centerline of the body) so that the foot is more toward the supinated position (i.e. closer to the position shown in FIG. 4*b*). However, as the person moves further through the gait cycle toward the 25% position shown in FIG. 7*a*, the leg rotates about its vertical axis in an inside direction so that the subtalar joint is pronating. The effect of this is to rotate the heel of the foot so that the point of pressure or contact moves from an outside rear heel location (shown at 52 in FIG. 7*b*) toward a location indicated at 54 in FIG. 7*b*. This pronating of the subtalar joint 36 produces a degree of relaxation of the midtarsal joint 38 and subsequent relaxation of the other stabilization mechanisms within the arch of the foot. This reduces the potential shock that would otherwise be imparted to the foot by the forward part of the foot making ground contact.

With further movement from the 25% to the 75% position, the leg rotates in an opposite direction (i.e., to the outside) so that the midtarsal joint 38 becomes supinated at the 75% location of FIG. 7*a*. This locks the midtarsal joint 38 so that the person is then able to operate his or her foot as a rigid lever so as to raise up onto the ball of the foot and push off as the other leg moves into ground contact at a more forward location.

With reference again to FIG. 7*b*, the initial pressure at ground contact is at 52 and moves laterally across the heel to the location at 54. Thereafter, the pressure center moves rather quickly along the broken line indicated at 56 toward the ball of the foot. As the person pushes off from the ball of the foot and then to some extent from the toes of the foot, the center of pressure moves to the location at 58.

c) The Intended Function of the Orthotic to Improve Operation of the Person's Foot and Leg Throughout the Gait Cycle If the person's foot were perfectly formed, then there would be no need for an orthotic device. However, the feet of most people deviate from the ideal. Accordingly, the function of the orthotic is first to position the plantar surface of the calcaneus 22 and the midfoot 45 so that the subtalar and midtarsal joints 36 and 38 are initially positioned properly (i.e., to bring the person's foot back to the ideal functioning position peculiar to the person's foot), and to thus control the subsequent motion of the foot parts or components that make up these joints so that the movements of the hip, leg and foot throughout the gait cycle are properly accomplished. It can be readily understood that if the components of the foot have the proper initial position and movement about the subtalar and midtarsal joints 36 and 38, the entire gait cycle, all the way from the coordinated rotation of the hips through the flexing and rotation of the leg, and also through the initial strike of the heel on the ground to the final push off from the toe of the foot, is properly coordinated and balanced for optimum movement. The only way that the plantar surface of the foot can be controlled is by a three dimensional member conforming to the plantar surface.

Since shoes are generally manufactured on a mass production basis, the supporting surface of the interior of the shoe may or may not optionally locate the plantar surface of the foot. Accordingly, it has for many years been a practice to provide an orthotic insert which fits within the shoe to optimize the locations of the foot components.

SUMMARY OF THE INVENTION

The orthotic of the present invention is a substantially unitary orthotic adapted to be placed in an article of footwear, the orthotic having a longitudinal center axis parallel to the lengthwise portion of a foot for which the orthotic is used, a transverse axis, a front portion, a rear portion, and two side portions.

The orthotic comprises a first upper relatively flexible blank portion extending laterally across a plantar area of said foot and extending longitudinally from a heel portion of the foot to at least a metatarsal head of the foot. There is a second lower relatively rigid cap portion positioned below the first blank portion and extending from the heel portion of the foot to a location rearwardly of a metatarsal joint of the foot, and also extending laterally across the plantar area. The cap has upwardly extending side walls along at least the side portions of the orthotic, and in the preferred form, also has an upwardly extending rear wall at the heel portion.

There is a moldable insert positioned intermediate the blank portion and the cap portion. This insert comprises at least a rear heel portion positioned at a rear portion of the heel of the foot, and at least one side portion positioned at an inside side portion of the orthotic. In the preferred form, the insert has a U-shaped configuration, with side portions extending forwardly from the heel portion at both side portions of the orthotic.

There is a relatively flexible and resilient pad portion having a rear heel portion underlying a middle heel portion of the foot, and a formed portion underlying a forward portion of the foot located rearwardly of the metatarsal joint.

The orthotic is characterized in that the insert is molded to conform to contours of the foot. Further, the orthotic is characterized in that the orthotic is relatively flexible along the longitudinal center axis in that the side portions of the orthotic can deflect moderately outwardly and also deflect upwardly and inwardly to cradle the person's foot when weight is being taken off the foot. Thus, upon initial ground contact, the side portions of the orthotic restrain outward expansion of side portions of the foot, while the orthotic cushions initial impact, and with the foot terminating ground contact, resiliency of the insert aids departure of the foot from ground contact.

In the preferred form, the blank extends forwardly beyond the metatarsal joint of the foot. Further, the blank, in the preferred form, is formed with a lower elongate recess to receive the pad.

A preferred form of the pad is that it has a laterally expanded front portion located approximately beneath the metatarsal head of the foot, and also an expanded heel portion positioned beneath the heel of the foot.

The pad portion is characterized in that it has greater resiliency than the blank portion, whereby the pad portion is able to deflect to a greater extent than the blank portion and yet return to its original configuration.

Also, in a preferred configuration, the forward portion of the cap portion is formed with a plurality of longitudinally extending slots to permit convenient removal of one or more parts of the forward portion of the cap portion.

In a modified form, the heel portion of the cap member is provided with a plurality of upstanding members adapted to engage a support surface of an item of footwear in which the orthotic is placed.

Also, in the preferred form, the cap portion is provided with a plurality of holes adapted to interengage with other portions of the orthotic to enhance joinder of, and relative positioning of, portions of the orthotic.

Other features of the present invention will become apparent from the following detailed description.

DETAILED DESCRIPTION OF THE PREFERRED EMBODIMENT

Figure 1:
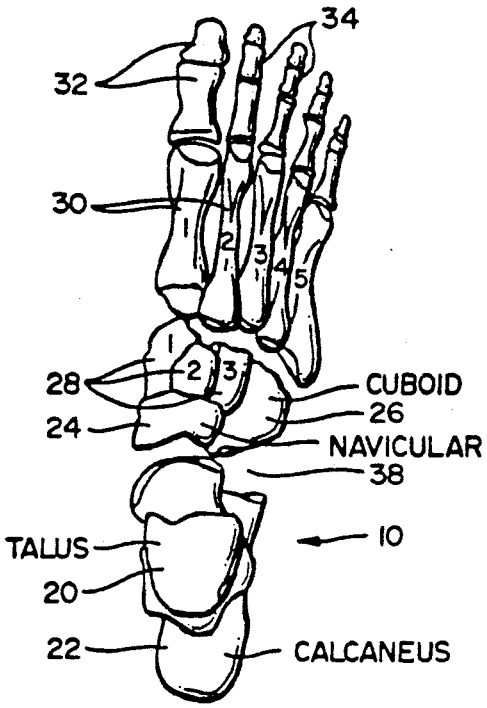
FIG. 1 is a top plan view of the right foot of a human, with certain components of the foot being separated from one another for purposes of illustration.
Figure 2:
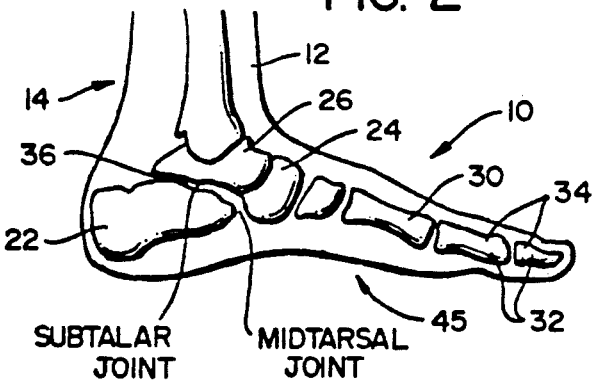
FIG. 2 is a side elevational view looking toward the inside of a person's left foot, with the outline of the foot and lower leg being shown as a shaded area.
Figure 3:
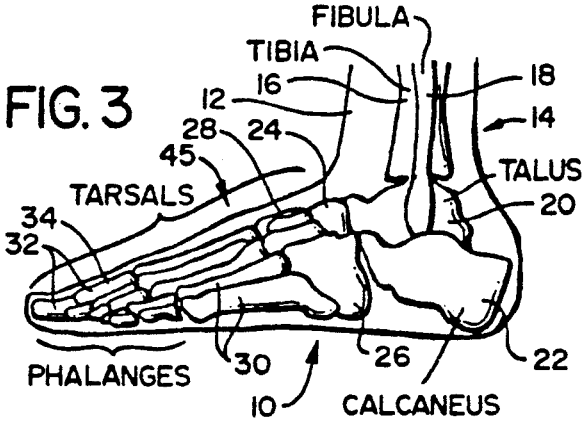
FIG. 3 is a view similar to FIG. 2, but looking toward the outside of the person's foot.
Figure 4A:
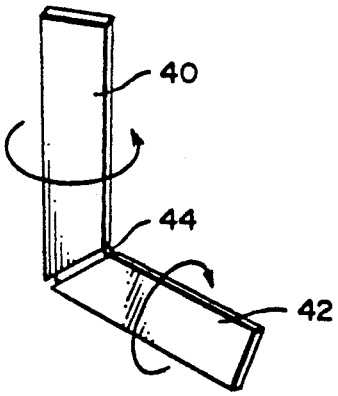
FIGS. 4*a* and 4*b* are perspective views illustrating schematically the rotational movements of the talus and calcaneus about the subtalar joint.
Figure 4B:
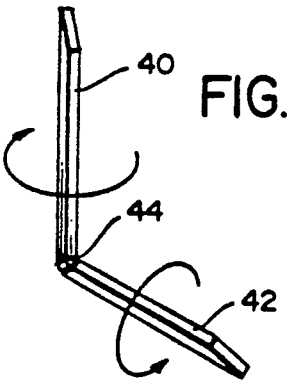
Figure 5A:
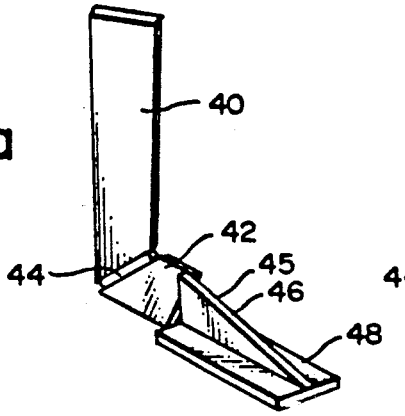
FIGS. 5*a* and 5*b* are schematic views similar to those of FIGS. 4*a–b*, but further illustrating the relative movement between the calcaneus and the midfoot about the midtarsal joint.
Figure 5B:
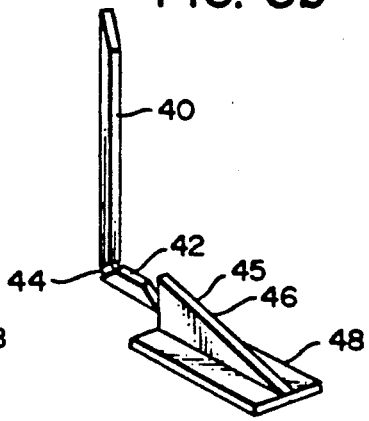
Figure 6A:
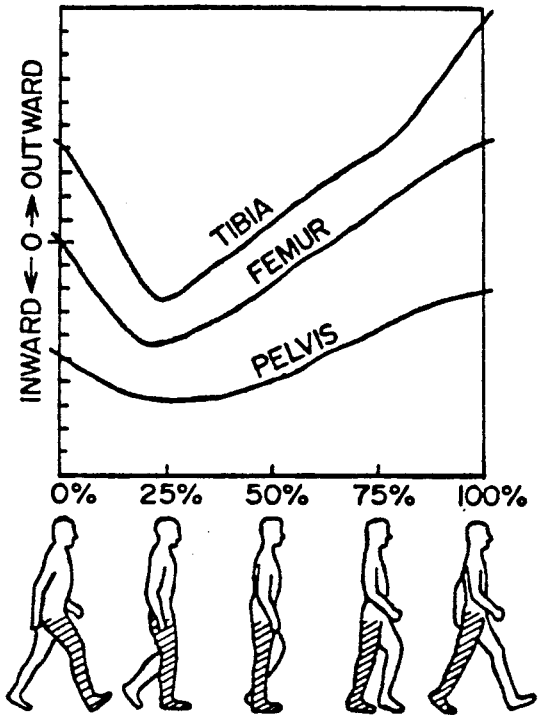
FIG. 6*a* is a graph illustrating the rotational movement of the pelvis, femur and tibia during one-half of a gait cycle.
Figure 6B:
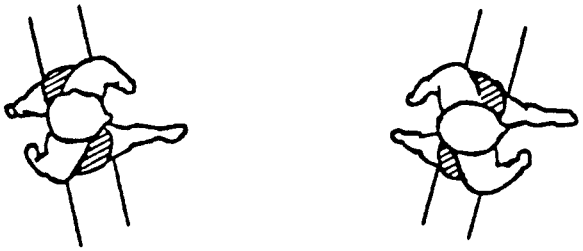
FIG. 6*b* is a top plan view illustrating the rotation of the person's pelvis during that portion of the gait cycle illustrated in FIG. 7*a;*
Figure 7A:
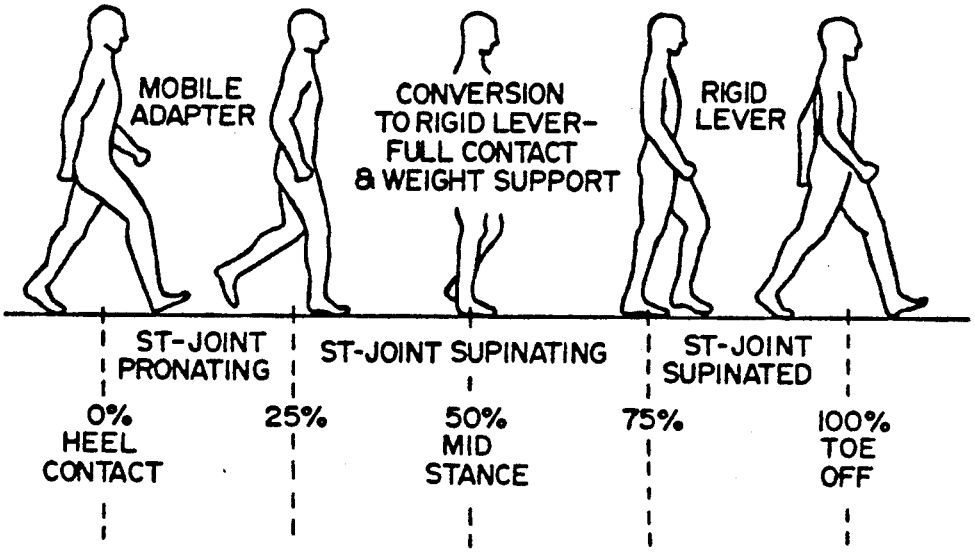
FIG. 7*a* is a graph similar to FIG. 6*a*, but illustrating the timing of the pronating and supinating motion of the leg and foot through one-half of a gait cycle.
Figure 7B:
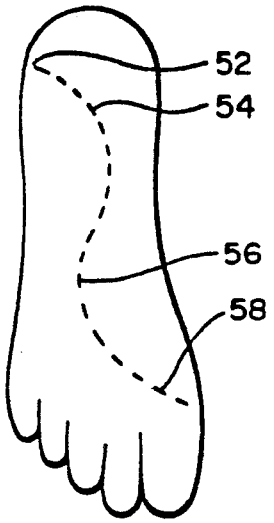
FIG. 7*b* is a view looking upwardly toward the plantar surface of a person's left foot, and illustrating the distribution or location of the center of pressure throughout the period of ground contact of the portion of the gait cycle illustrated in FIGS. 6*a* and 7*a;*
Figure 8:
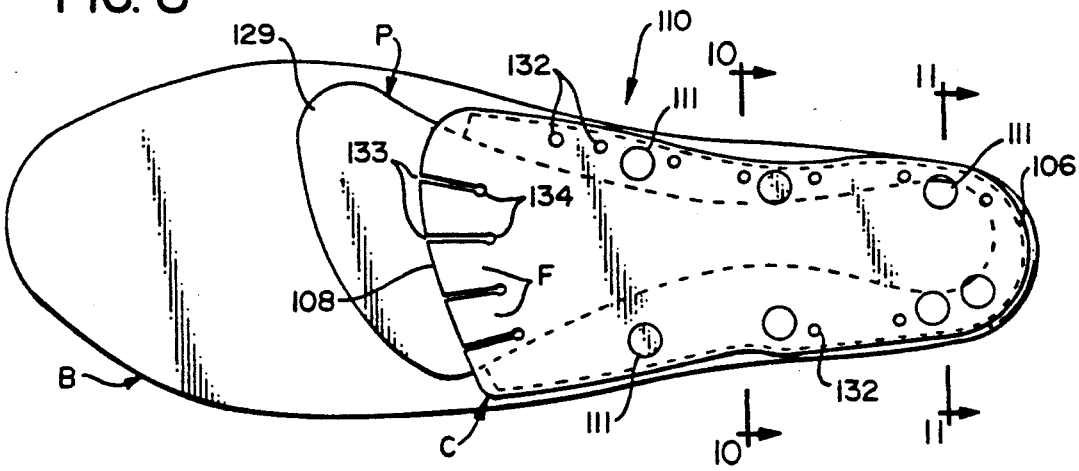
FIG. 8 is a bottom plan view of an orthotic made in accordance with the present invention.
Figure 9:
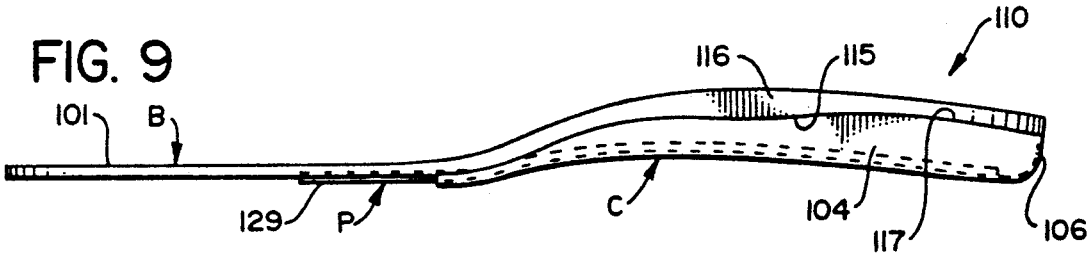
FIG. 9 is a side elevational view thereof.
Figure 10:
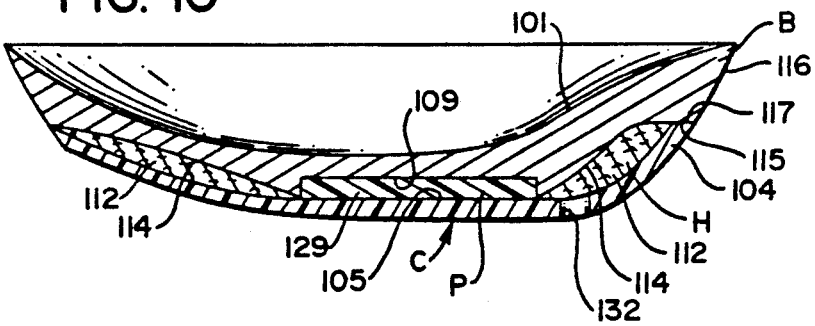
FIG. 10 is a sectional view taken along line 10—10 of FIG. 8.
Figure 11:
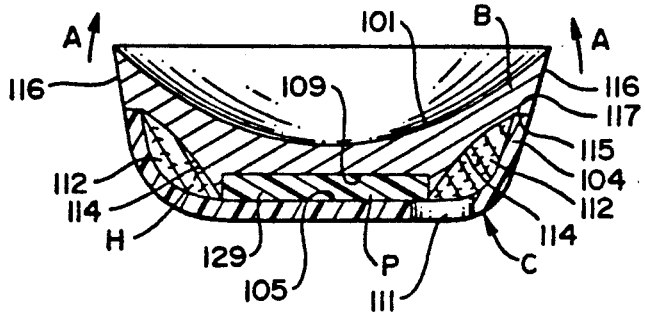
FIG. 11 is a sectional view taken along line 11—11 of FIG. 8.

In FIGS. 8–15, there are shown the four main components which are utilized to make the orthotic of the present invention, generally designated 110. These four components are a full length blank B defining a topmost portion of the finished orthotic, a cap C which defines the lowermost portion of the finished orthotic insert 110, a resilient pad 129 and a horseshoe-shaped cork resin insert 112.

In describing the present invention, first these four components will be discussed in detail. Then, with reference to FIGS. 16–39, the manner in which these are formed into the finished orthotic insert will be described.

The full length upper blank B has a top surface 101 formed from an abrasion resistant padded material such as synthetic fabric, nylon, dacron, felt, cloth or the like and a resilient underlying substrate 102 formed from rubber or its equivalent which padded material and rubber substrate are interconnected by means of adhesion or fusion. The lowermost portion of the full length blank B defines a bottom layer 103 formed from a foamed material such as Freelen TM, Plastizote TM, or any other opened or closed cell foam characterized as being relatively resilient, having sufficient memory to return or its original state when unstressed, and capable of moderate shock absorption.

The cap C is formed from a material which is comparatively rigid when contained with the upper full length blank B, and may be formed from polyethylene, polypropylene (with or without diluents such as talc), epoxy and fiberglass, graphite fibers combined with a resin, polyurethene fibers bound in a resin, or kelvar fibers with resin; all of the above preferred constituents of the cap being characterized as having a predetermined and programmable resistance to deformation and torsion in such a manner that when distorted, fibers associated therewith (or plastics as poured) react to deformation in a desired manner to be defined hereinafter.

This member 112 is preferably formed from a cork resin mixture characterized in its ability to expand two to three times its original volume when heated and as shown in the drawings is of substantially U-shaped configuration partially defining and further enhancing an elongate longitudinal recess 109 disposed on and provided on the bottom face of the blank B. The cork resin layer 112 has a contour complemental to a portion of the bottom surface of the full length blank B so that there is natural registry therebetween. More specifically, a bottom portion of the blank B is provided with a peripheral marginal wall 114 that extends from the heel area forward and tapers to a relatively smooth transition adjacent the metatarsal head area of the foot, and has a complex contour adapted to receive the similarly formed cork resin intermediate layer 112 thereat. The cork layer resin 112 has a central void, so as to define its U-shaped configuration, and also to allow the disposition therein of the resilient pad 129 having a rear portion complemental to the configuration of the U-shaped cork resin intermediate layer so that there is minimal overlap. Thus, the resilient pad 129 has a somewhat bulbous heel area 129*a* which narrows along a medial extent 129*b* thereof and flares forwardly and outwardly to the metatarsal head area, as at 129*c*. The resilient pad 129 terminates at 129*d* just forwardly of the metatarsal phalangeal joint of the user so that the metatarsal head of the person wearing the device is provided with an underlying pad. In order to accommodate the resilient pad 129, a complementally formed recess 109 is provided on a bottom face of the blank B so that there is readily and facile registry between the resilient pad 129 and the recess 109.

In addition, the marginal wall 114 of the blank B is sufficiently sculpted as is the horseshoe-shaped cork resin intermediate piece 112 that the cap C can have its upwardly extending edge 117 of peripheral wall 104 engage the peripheral shelf 115 disposed around the blank B. As shown in the drawings, an upper rim 116 of the blank B is provided above the shelf 115, and is suitably contoured such that when all elements are assembled, a smooth transition exists between the lateral wall of the cap C and the blank B, since the shelf 115 is dimensioned to accommodate not only the thickness defined by edge 118 of the cap wall 104, but also the cork.

Thus, the top surface of the cork resin layer 112 has a contour complemental to the registering bottom surface of the full length blank B so that there is natural nesting therebetween. A characteristic of the cork resin composition is that upon heating and expansion, it will deform under pressure (as by one's foot in a controlled wearing situation) to fill any associated void, and therefore the cap C formed of the material set forth as above will define the finished bottom configuration of the cork resin layer 112 with the cork resin adapted to be received within the associated apertures of the cap as will now be defined.

Figure 12:
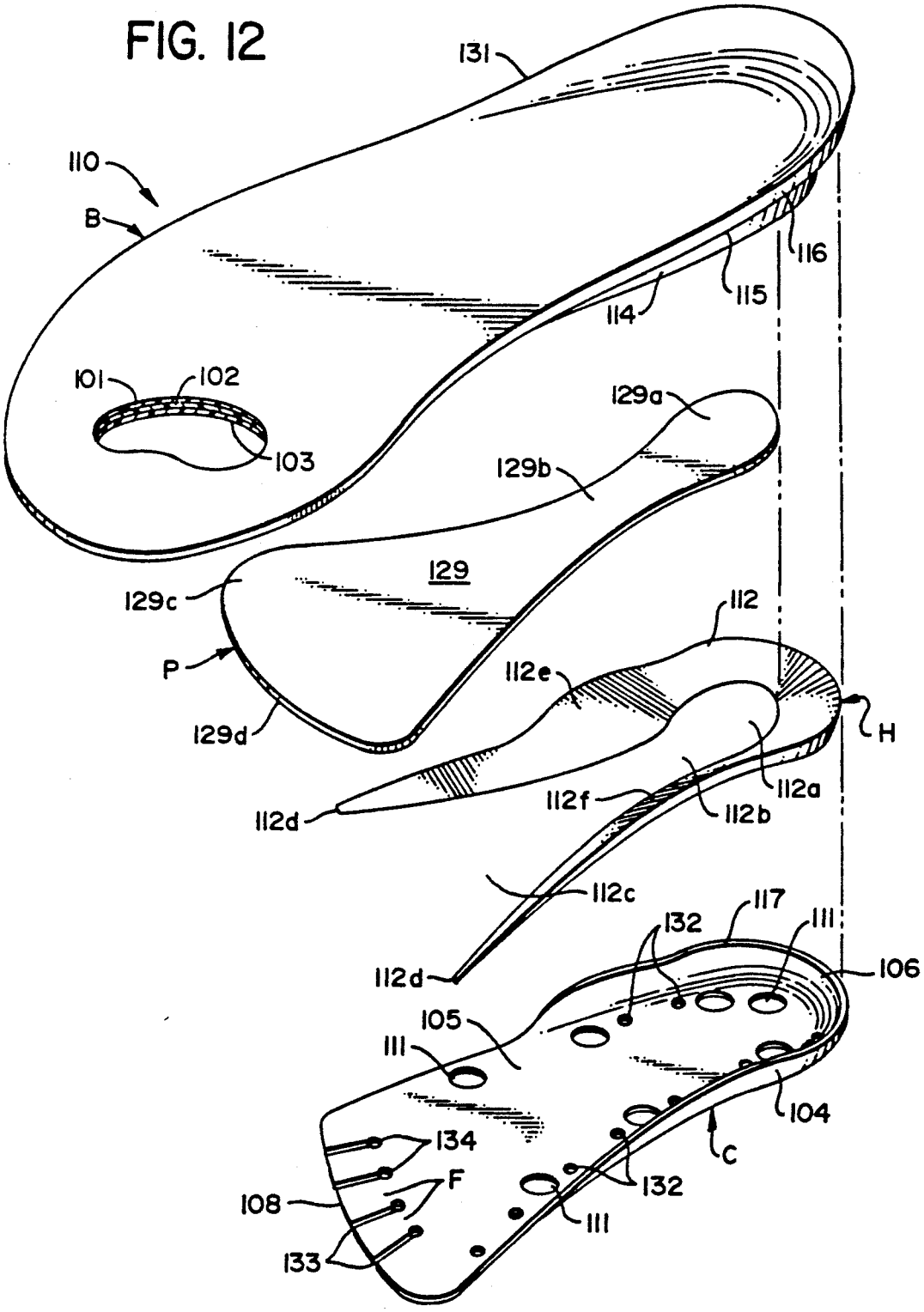
FIG. 12 is an isometric exploded view showing four main components which are used to form the orthotic insert of the present invention.

A plurality of apertures 111 are provided on the medial and lateral segments of the cap C, and as shown in FIG. 12 are disposed on the horizontal plantar surface 105 of the cap. When the cork is suitably heated, the apertures 111 along with smaller apertures 132 are adapted to be filled with the cork resin so that the cap C is inextricably bound to the cork. In turn, the cork is of such a nature that it will react and bind to the Plastizote TM, or Freelen TM bottom surface of the blank B so that the device is provided with a unitary structure. Since some of the cork will also expand sufficiently to engage a portion of the resilient pad 129, the pad 129 will also become an intrinsic part of the composite thus formed. Additionally, as can be readily understood, the apertures 132 or 111 can initially be provided with resilient plugs of sorbathane or the like prior to heating of the cork resin layer, and the associated plugs will thus be bonded to the orthotic insert. Alternatively, the bottom surface of the blank B can be made with small downward protrusions to fit in some of the openings 111 to properly position the blank B with the cap C.

The full length blank B is provided along the medial, lateral and heel aspect with a side wall 114 adapted to be dimensioned in accordance with the width and heighth of the corresponding walls 114 of the cap so that when upon assembly, a flush peripheral wall is provided. To this end, the side wall 114 defines (along with the shelf 115 and an upper rim 116 offset from the wall 114) a periphery so that the thickness of the cap 17 is substantially to same at the shelf dimension 115 for nesting engagement. Since some migration of the cork resin will occur between the inner face of wall 104 of the cap and the side wall 114 of the blank B, a bonding has been effected there as well. As is apparent from viewing FIG. 12, the cork resin layer is provided with peripheral edges that have a feathered taper, so that cork migration into adjacent areas of the blank and the cap can readily occur.

Thus, with the provision of the resilient pad 129 in combination with the cork resin layer 112, an orthotic appliance has been provided which has an improved characteristic of resiliency and resistance to uncontrolled deformation, and by virtue of its lamination between not only the blank B but also the cap C, strength derived from the cap will allow distortion of the insert during the normal gait cycle without delamination or deterioration of the components. Since the cork resin lends itself to ready deformation when heated, multiple orthopedic adjustments are possible by use of the cork resin layer 112. While the preferred material for the insert 112 is the cork resin material, other materials having comparable characteristics could be substituted.

The cap C also includes a metatarsal head area 108 provided with a plurality of longitudinally extending slots 133, each slot terminating in an aperture 134. In this case, it should be clear that the resilient pad 129 extends beyond the length of the metatarsal head area and in fact extends closer to the toes, forward of the cap C. Thus, the leading edge of the cap C is appropriately cushioned and supplemented with additional resilience by means of the resilient pad 129. In this manner, relieving pressure on certain metatarsal head arear can be evidenced for the benefit of people experiencing metatarsal discomfort, commonly geriatric patients. One preferred technique would be to remove a portion of the cap C that extends between adjacent slots 33 so that area of the foot is at a different horizontal level when receiving pressure from the support the cap provides on the foot, providing a relieved area. Additionally, it is contemplated that providing the apertures 134 with resilient fingers F or the like for elevating certain areas to the exclusion of others can provide an additional benefit. Thus, a topographical disparity can be provided along the metatarsal head area for the associated benefits and the concomitant pressure release.

As shown in the drawings, the cap has a main surface 105 which includes the apertures 111, which peripherally run along a medial, lateral and calcaneal aspect of the cap surface. In addition, a plurality of smaller dimensioned apertures 132 are similarly provided adapted to receive either resilient fingers, cork resin, or the equivalent for similar associated purposes and benefits. The marginal wall 104 includes a curved top edge 117 that includes a rear wall 106 of substantially uniform heighth, but as the wall extends forwardly, each side is provided with one downwardly extending undulation each respectively offset from the other in a plane transverse to the longitudinal axis, and thereafter an upwardly curved segment ultimately tapering downwardly to the flat area of the cap proximate to the metatarsal head area. A complemental contour on the peripheral wall 114 of the full length blank B is also defined so that an interlocking is provided by the netting arrangement of the shelf 115 and the top edge 117 and the undulations serve not only to assure registry of the blank and its cap, but also to encourage deformation of the two relative to foot pressure in a predetermined manner. It is to be noted that the medial marginal side wall has greater length than the lateral wall and corresponds to and underlies the blank's arch support so that the upwardly extending portion forward of the undulation of the medial side thereof underlies and causes additional beneficial support of the arch member, a consideration not necessary on the lateral aspect of the foot on its associated opposite side.

Figure 13:
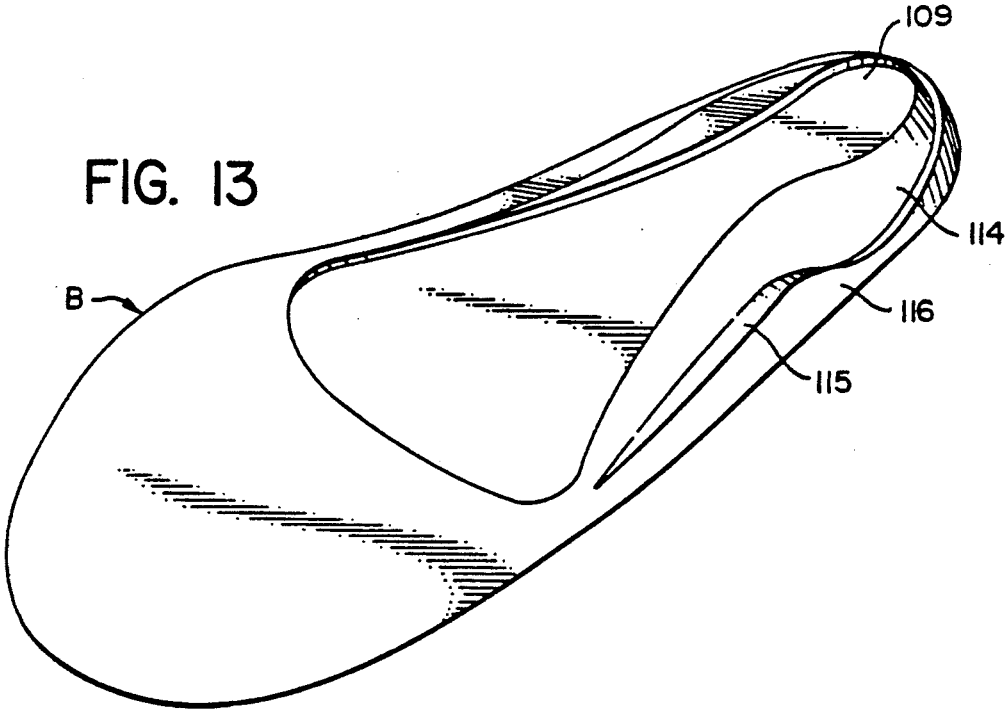
FIG. 13 is an isometric view looking toward the bottom surface of the blank which is used to make the orthotic of the present invention.

It is to be noted that the horseshoe-shaped cork resin layer 112 has a middle opening to receive therewithin the resilient pad 129. The inner opening area near the bight portion of the horseshoe-shaped cork resin layer 112 has a bulbous rear opening portion 112*a* immediately adjacent the calcaneal area of the foot, and inwardly directed tapered or necked down opening area 112*b* slightly forward the calcaneal area and an outwardly flared forward opening area 112*c* that increases to the area where the metatarsal head extends transversely across the foot. The leading edges of the horseshoe-shaped cork resin layer 112 each come to a point 112*d*, and the area of the cork resin layer immediately forward the calcaneal area is thickened as at 112*e* and 112*f* and has greater which so that the cork resin layer can be caused to expand along the medial and lateral aspect of the foot to provide additional support along the arch area on the medial aspect, and on an opposed lateral aspect as well. As shown in FIG. 13, the wall 114 of the blank B has a contour complemental to that of the cork resin layer 112. Since the edges of the cork resin layer are feathered in all extents, nesting interfit with the cap C, the resilient pad 129 and the blank can occur with no discernable dimension problems, and in fact, when the cork resin layer is heated, voids associated with peculiarities of the insert as it relates to a person's foot can all be accommodated by the expansion of the cork/resin into those recesses, which can also include the apertures 111 and 132 of the cap C. In a preferred form of the invention, the resilient pad 129 can be affixed to the bottom surface of the blank B by adhesion, fusion or the like and is additionally retained therein by overflow of the cork resin along the peripheral border between the recess 109 of the blank and the resilient pad 129. As shown in FIG. 12, the top peripheral edge 131 of the blank B is feathered so that this edge provides no impediment to the user when donning the inserts, or in their utilization during flexure of the foot.

Having described the structure of an orthotic appliance incorporating the present invention, the function thereof with respect to correctly aligning the person's foot during the gait cycle will now be described. As was described above, a longitudinally extending recess 109 is formed in the lower surface of blank B. This recess provides a zone of disparate resiliency relative to those areas adjacent to the zone, so that in the course of the gait cycle, the insert is deformed in a controlled manner under the weight exerted by the associated foot so that the appliance, by its controlled deformation, encourages the foot to be oriented in such a manner that the foot is disposed in a neutral position as it transitions from a mobile adaptor to a rigid lever. This ensures that the tarsal joint and its relationship to the subtalar joint is relatively neutral as the midtarsal joint becomes locked (as previously described), so that the transitional forces along the bone structure from the foot, through the ankle and up the leg, occur in a most efficient manner, and unwanted stresses are avoided. In other words, the zone of disparate resiliency deforms in a predetermined fashion so as to accommodate the distortion of the foot while concomitantly urging the foot into the preferred neutral position during the critical phase of the gait cycle from heel strike to mid-gait.

The use of a cushioning pad in the recess which is provided in the bottom surface of the insert additionally permits the zone of disparate resiliency to be altered to accommodate different conditions by altering the durometric value of the resilient material of the pad. The horseshoe-shaped cork resin insert augments the zone of disparate resiliency so as to enhance its function in aligning the foot. As will be described below, the cork resin insert expands when heated, and is then deformable in a controlled manner with application of suitable pressure, so that this piece can be accurately deformed by pressure against the foot when the foot is in a locked or rigid lever position. Thus, after the insert takes a set, it will continuously and dynamically urge the foot into this neutral position as the foot transitions from heel strike to mid-gait during the gait cycle. The rigid lower cap (as will also be described below) can also be configured to allow further controlled deformation of the orthotic so as to enhance alignment of the foot, by structuring into the cap additional preferred areas of yielding deformation. These may preferably be configured to further encourage heel cupping and insert deformation so as to accommodate and align the foot during elongation, and during the transition from heel strike to the mid-gait and toe roll phases of the gait cycle.

Figure 14:
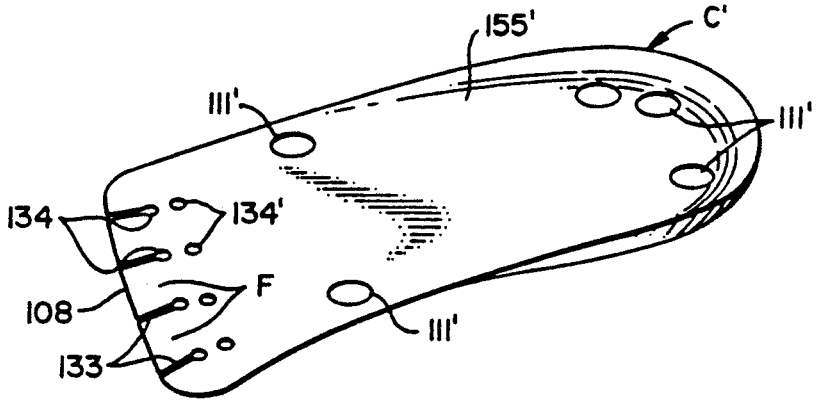
FIG. 14 is an isometric view of a modified type of cap which can be used as one of the components to make the orthotic of the present invention.
Figure 15:
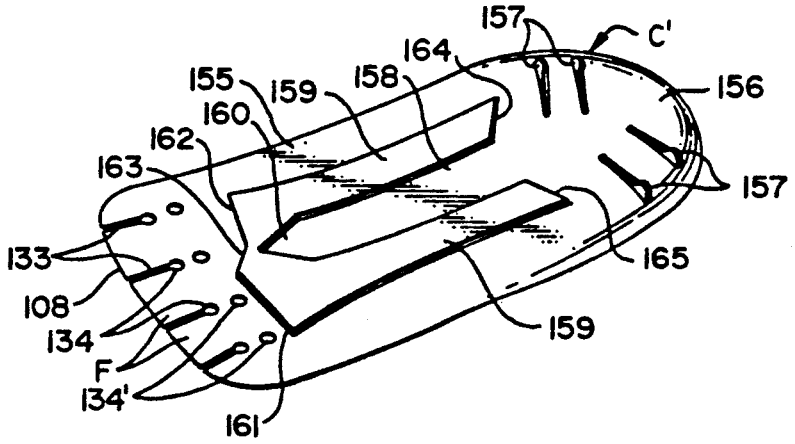
FIG. 15 is an isometric view looking toward the bottom surface of the cap shown on FIG. 14.
Figure 16:
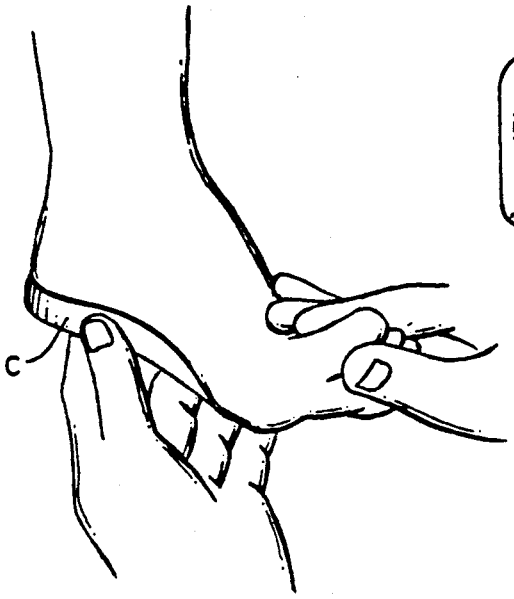
FIGS. 16 through 39 are a series of isometric views illustrating the preferred method used in making the orthotic of the present invention.

FIGS. 14 and 15 show respectively top and bottom perspectives of a further type of cap $C^1$ which manifests certain differences over the cap as shown in the other drawing figures, but the like reference numerals will be repeated here. More particularly, the cap $C^1$ includes a bottom surface 155 having a leading edge 108 adapted to terminate adjacent the metatarsal area of a person's foot, and similar slits 133 are provided extending longitudinally along the cap $C^1$ terminating in enlarged apertures 134. Sightly rearward of the rounded apertures which communicate with the slits 133, further apertures 134$^1$ are provided for the insertion thereof of resilient fingers as was shown in FIG. 12. The top surface 155$^1$ of the cap $C^1$ has a contour complemental to the configuration of the plantar surface of a person's foot, and the bottom surface of the cap includes an arcuate heel area 156 and two pairs of radially extending skeg type devices 157 which provide beneficial pronation of a person's foot by virtue of the skeg's upwardly extending nature, so that the removal of one or more skegs 157 from one side or the other of the cap $C^1$ can provide angulation. In addition, the skegs 157 being of wedge-like configuration having a tapered point adjacent the calcaneal central heel area and a widened area outboard therefrom serve to enhance heel cupping, and a fairly rigid cap is required to use the skegs in heel posting. In addition, the bottom face of the cap $C^1$ has a central recess 158 bordered by first and second strips 159 terminating in a V-shaped recess 160 and includes a first section 161 at a leading edge thereof having a linear forward edge, and a second edge 162 declinated rearwardly along the medial aspect of a person's foot. A transition 163 is provided between the leading edges 161 and 162 and angled so that the transition between the two edges 161 and 162 is somewhat uniform. Trailing edges of the upwardly extending portions 164 and 165 allow the central area 158 to serve as a zone of disparate resiliency by providing a relatively weakened area thereat so as to encourage additional heel cupping.

To describe the manner in which the components described above are combined to make the orthotic insert 110 of the present invention, reference is now made to FIGS. 16–39. For ease of description, the cap will continue to be referred to by the letter "C", and the blank will continue to be referred to by the letter "B". The resilient pad 129 will be in the following description referred to by the letter "P", and the horseshoe-shaped cork resin insert 112 will be referred to by the letter "H".

Generally, the first step is to have the person for whom the pair of orthotics are being made to sit on a raised chair. Then the cap C is placed against the person's foot to check for size. The leading edge of the cap C should reach just behind the metatarsal heads of the person's foot.

Figure 17:
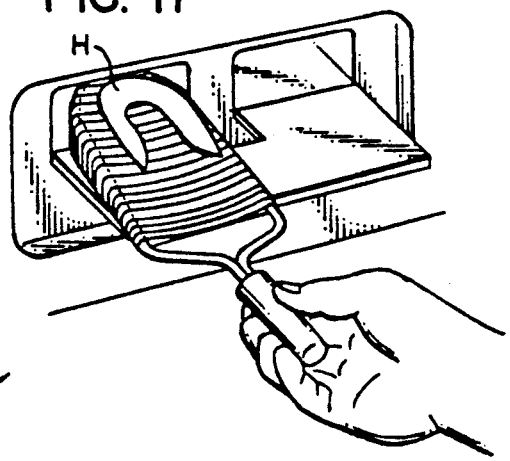
Figure 18:
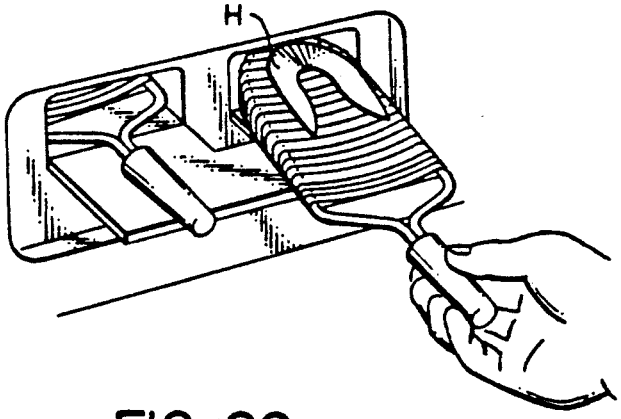

As illustrated in FIG. 17, a two component oven is provided, and one of the horseshoe-shaped cork resin inserts H is placed on a spatula and inserted into one oven compartment. As illustrated in FIG. 18, after about 90 seconds, a second insert B is inserted into the other compartment. The temperature in the oven is sufficiently high (e.g. moderately in excess of 200° F.) to cause the insert B to soften and expand to two or three times its original size.

Figure 19:
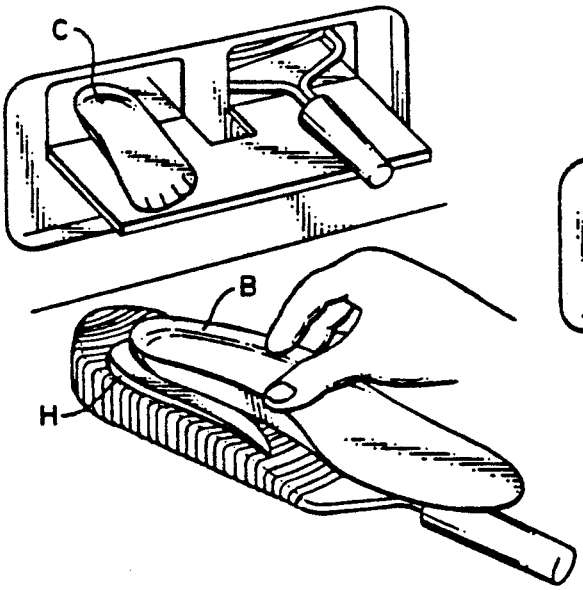

Approximately three minutes after the first insert H is placed in the oven, the first insert H is removed from the oven, and while it is still on the spatula, the blank B is placed onto the insert H, as illustrated in FIG. 19. The resilient pad P is already fitted into the bottom recess in the blank B prior to placing the blank B onto the insert H. At the same time, the cap C which is to be used for the orthotic now being assembled is placed in the oven compartment.

Figure 20:
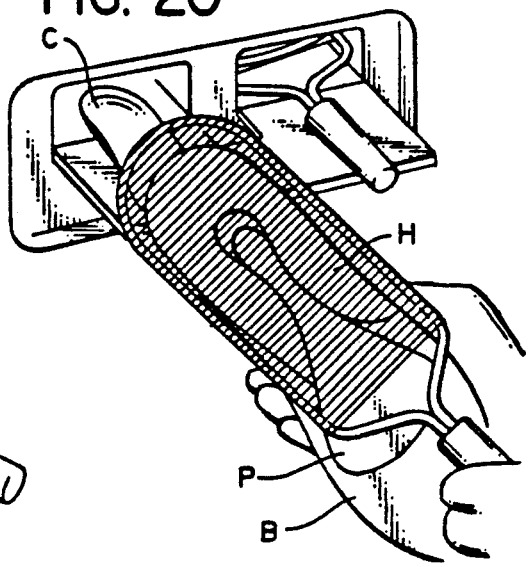

Then, as illustrated in FIG. 20, the spatula is inverted and the blank B is held in the operator's hand. The insert H will stick to the blank B and release from the spatula.

Figure 21:
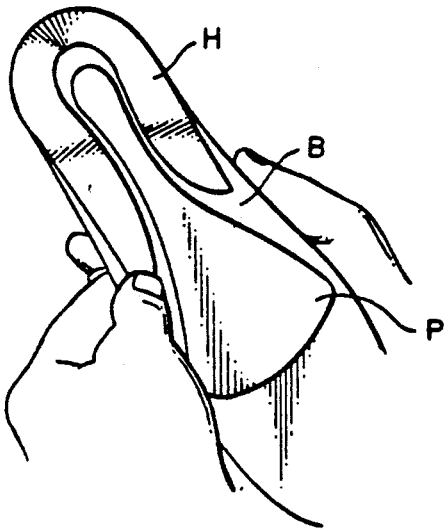
Figure 22:
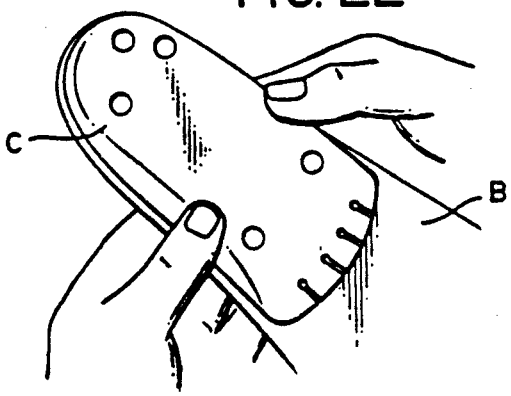
Figure 23:
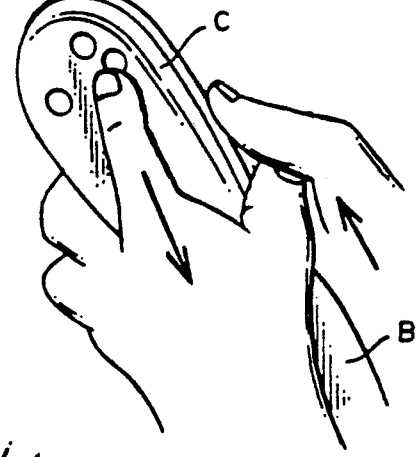

As illustrated in FIG. 21, the next step is to align the insert H squarely on the molding outline of the blank B. By this time, the cap C which is in the oven has been warmed, and as illustrated in FIG. 22, the cap C is then placed against the insert H and the blank B. In the event that the insert H or the blank B are formed with slight protrusions to match the openings formed in the cap C, then the cap C is aligned so that such protrusions fit into its openings.

Figure 24:
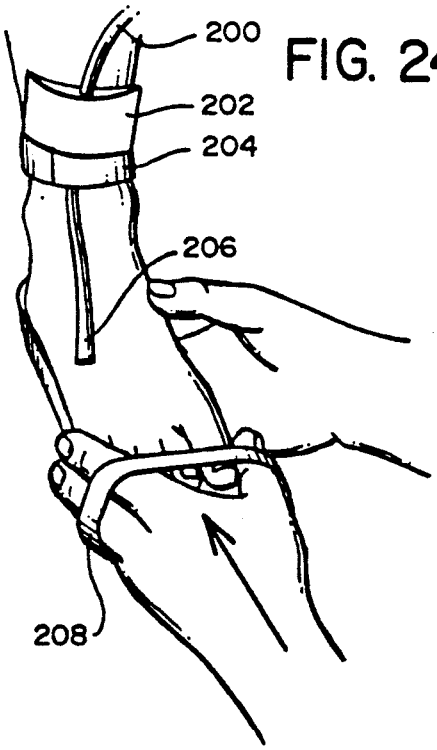

Next, there is the utilization of the vacuum forming technique to properly form the assembled components to the bottom of the foot. As illustrated in FIG. 24, there is a suction tube 200 that is applied to the person's ankle by means of a fitting 202 and an elastic band 204. The intake end 206 of this tube 200 is on the upper surface of the person's midfoot. An elastic band 208 is slipped around the person's foot to hold the assembled components in place.

Figure 25:
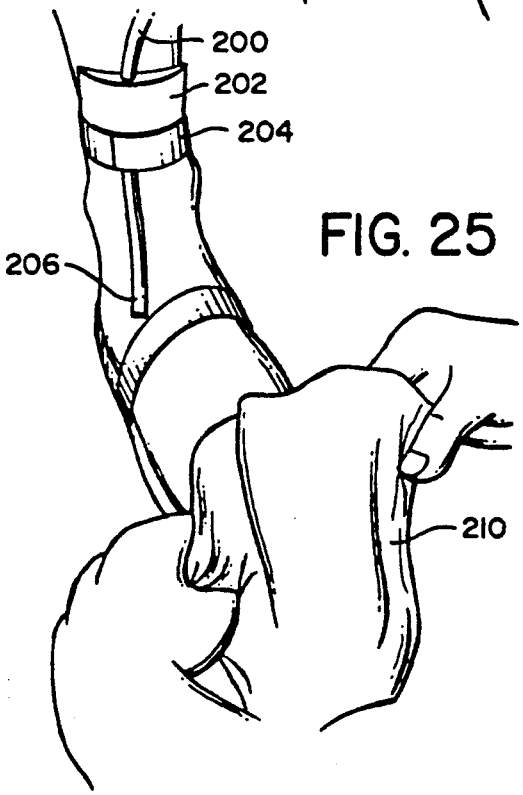
Figure 26:
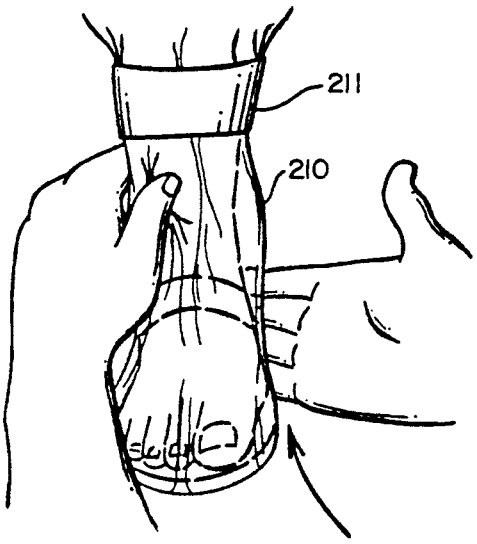

As illustrated in FIG. 25, the next step is to place a flexible transparent plastic bag 210 around the foot, and upwardly around the ankle. As shown in FIG. 26, the upper part of the bag which is around the ankle is pressed against the ankle by means of a peripheral band 212. The assembled components (i.e. the cup C, the insert H and the blank B with the pad P) are pressed gently against the heel. Then a vacuum pump is turned on to suck air through the tube inlet 206 to press the assembled components against the bottom of the foot with the appropriate pressure.

Figure 27:
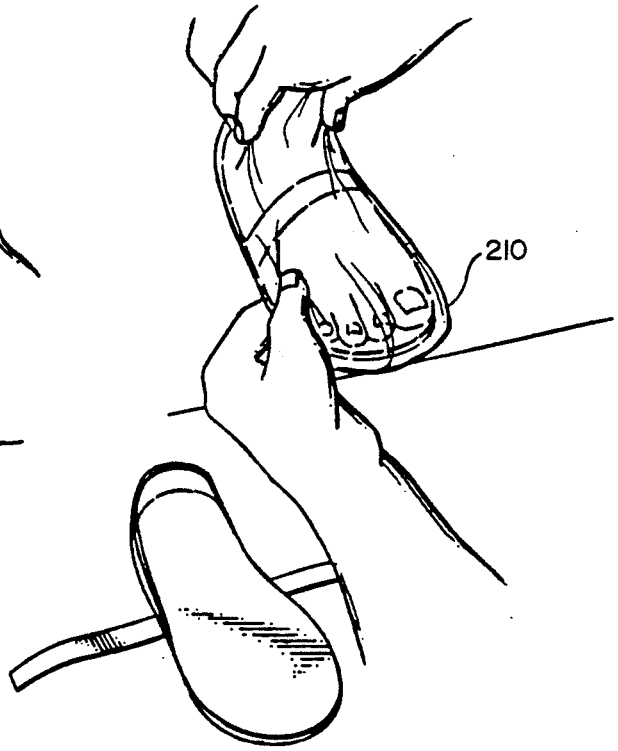

Then, as illustrated in FIG. 27, the operator grasps the forward part of the person's foot with one hand and grasps the rear part of the foot with the other hand at approximately the location of the talus. The operator then positions the foot in a manner to confirm the neutral and locked position of the foot for approximately ten seconds.

Figure 28:
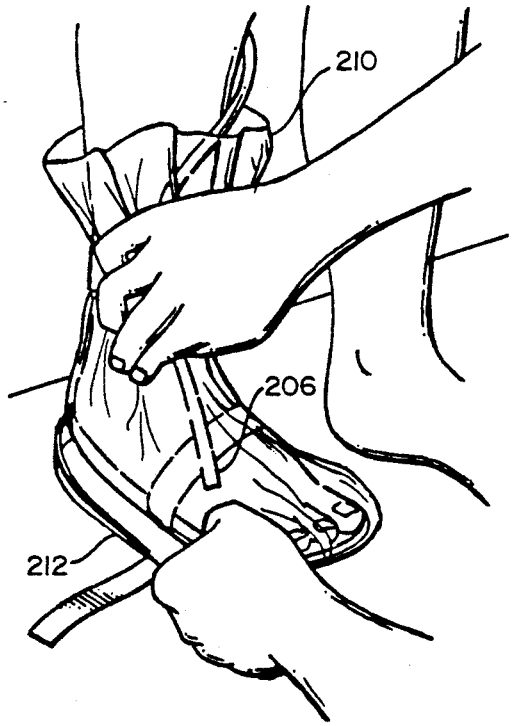

Then, as illustrated in FIG. 28, the person for whom the orthotic is being made is asked to step down from the chair, bearing his or her weight on the other foot in a manner so as to make light weight contact of the cap C with base member 212 which is contoured to represent the sole of a shoe into which the orthotic is to be inserted. (Under some circumstances, the forming can be accomplished solely by the vacuum, without the person placing weight on the foot. Also, the vacuum bag can be placed around the person's foot with a shoe being on the foot.)

Figure 29:
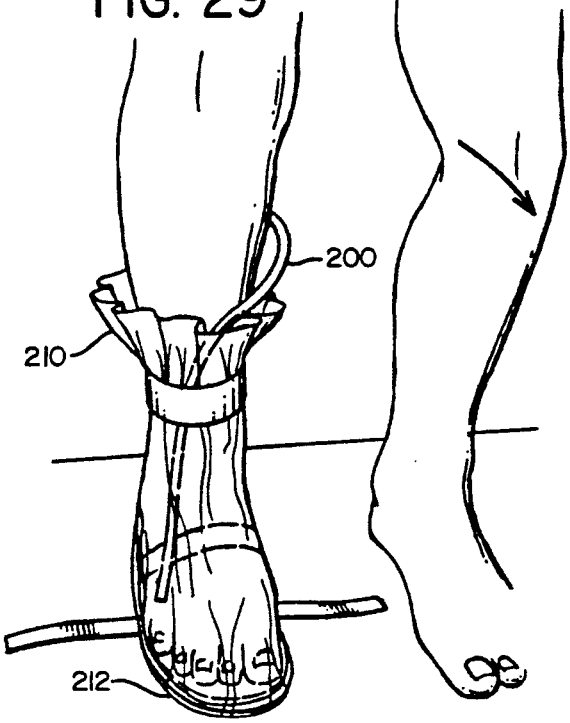

Then, with the person's feet being about four to five inches apart, the person is asked to flex his or her knees forwardly so that the person's knees are positioned above the forward part of the foot. This motion is illustrated in FIG. 29.

Figure 30:
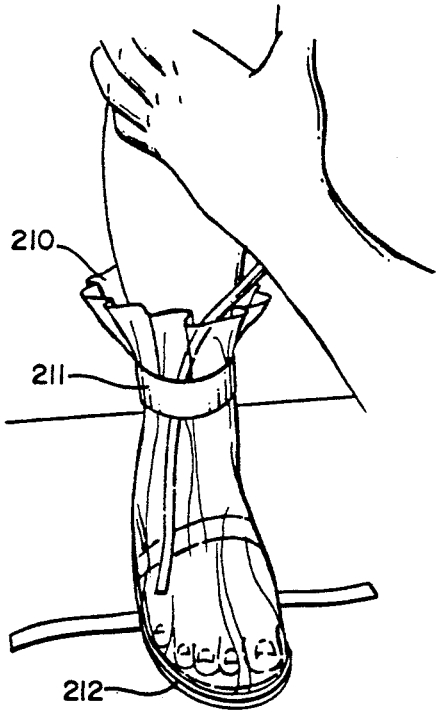
Figure 31:
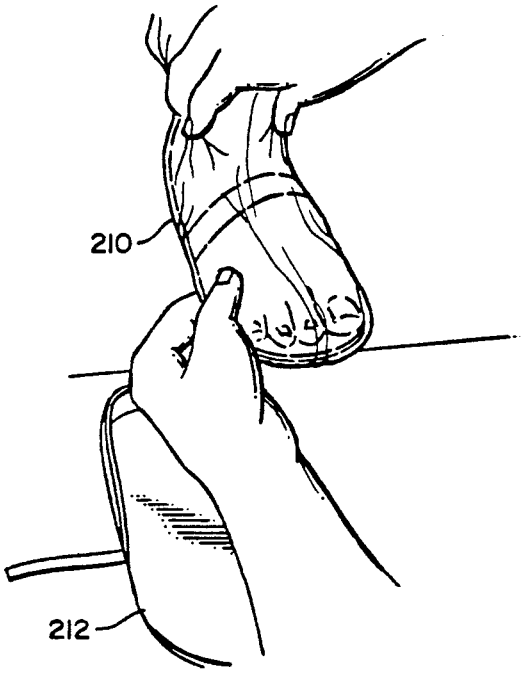

When the person's position is stable, the person is asked to transfer his or her weight equally to both feet. The operator holds the tibia steady, as illustrated in FIG. 30, and the person is asked to sit down. At the same time, the operator picks up the person's foot and repositions the foot in the neutral and locked position. As illustrated in FIG. 31, the foot is held in this neutral and locked position for approximately thirty seconds. At the end of that time, the temperature of the components has dropped so that the U-shaped cork/resin insert I has hardened, and the basic structure of the orthotic 110 is formed. The bag 210, the band 208, and the vacuum components 200–206 are removed from the person's foot and ankle, and the orthotic 110 is removed. Then the entire procedure can be repeated with the person's other foot.

Figure 32:
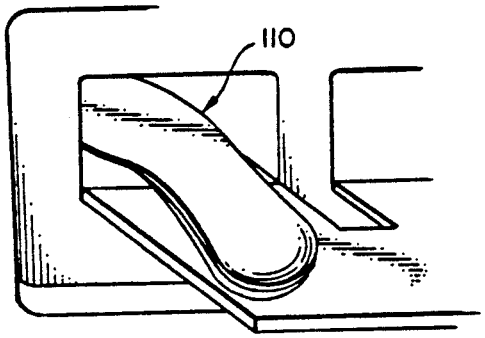
Figure 33:
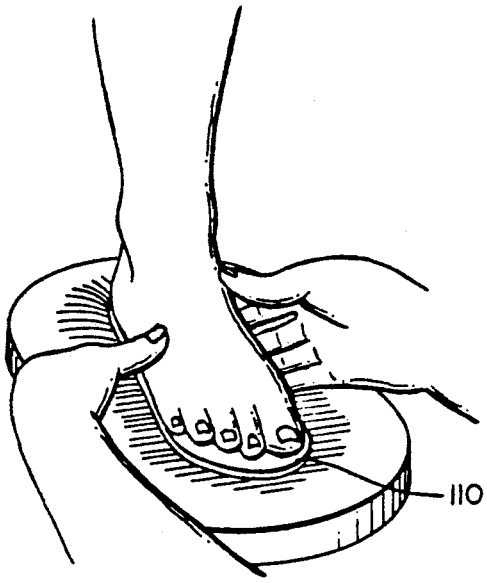
Figure 34:
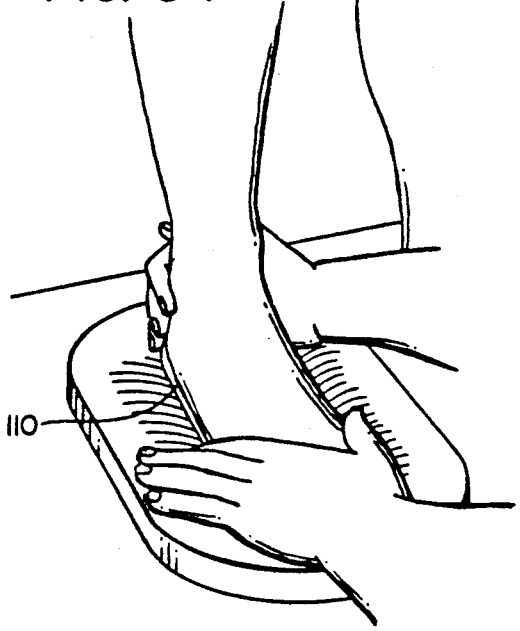

The procedure which will now be described with reference to FIG. 32 and following is an optional feature to further conform the forward part of the orthotic (i.e. that part formed by the forward part of the blank B). With reference to FIG. 32, the forward part of one of the orthotic 110 is placed in the oven so that only the forefoot portion of the orthotic is heated so as to be deformable. Then, as illustrated in FIG. 33 the orthotic is placed on a pad of yielding foam material, and the person's foot is placed on top of the orthotic. Then the person is asked to step down gently on his heel onto the rear heel portion of the orthotic, but only with slight weight contact. Then, as illustrated in FIG. 34, the operator holds the person's toes together gently and asks the person to bend the knee forward sightly while lifting the heel.

Figure 35:
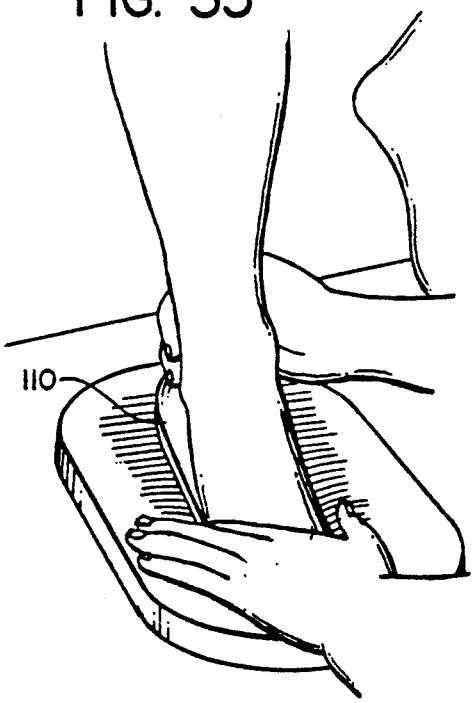
Figure 36:
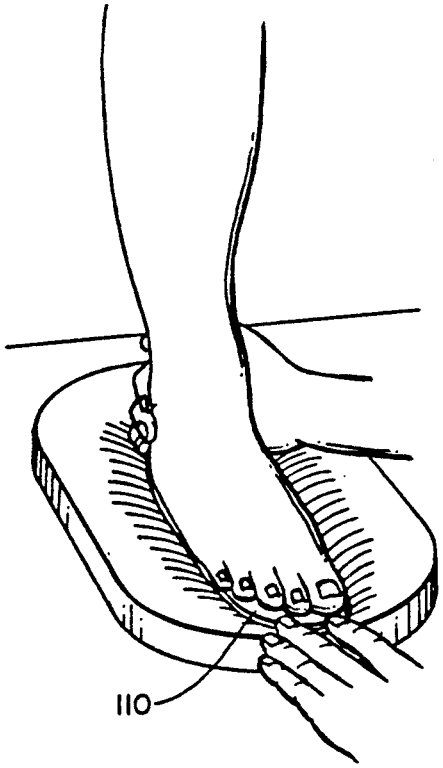

Then, as illustrated in FIG. 35, the operator asks the person to transfer all of his or her weight onto the foot that is placed on the orthotic 110, while lifting the other foot. This position is held by the person for about ten seconds. Then the operator asks the person to transfer his or her weight back to the other foot (i.e. the foot not on the orthotic 110) and the person's heel is lowered gently into contact with the rear portion of the orthotic 110. The operator then elongates and flattens the toes against the orthotic, and this position is held for about ten seconds, as illustrated in FIG. 36.

Figure 37:
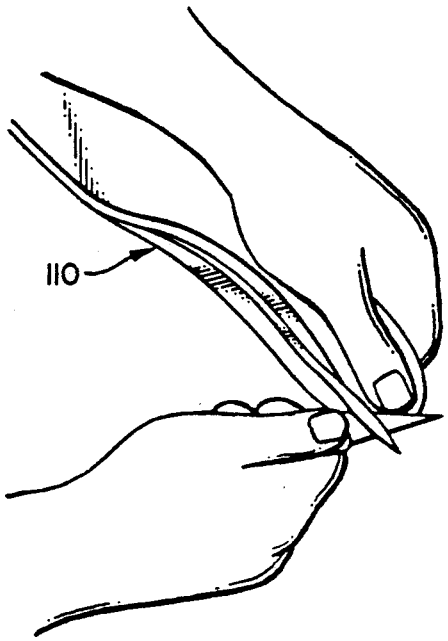
Figure 38:
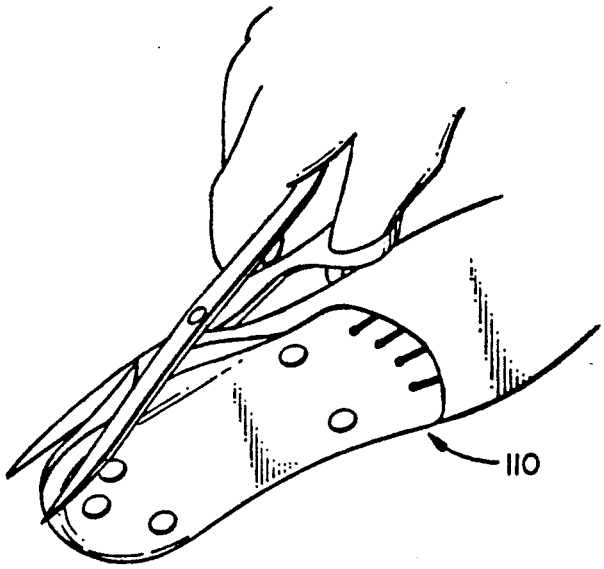
Figure 39:
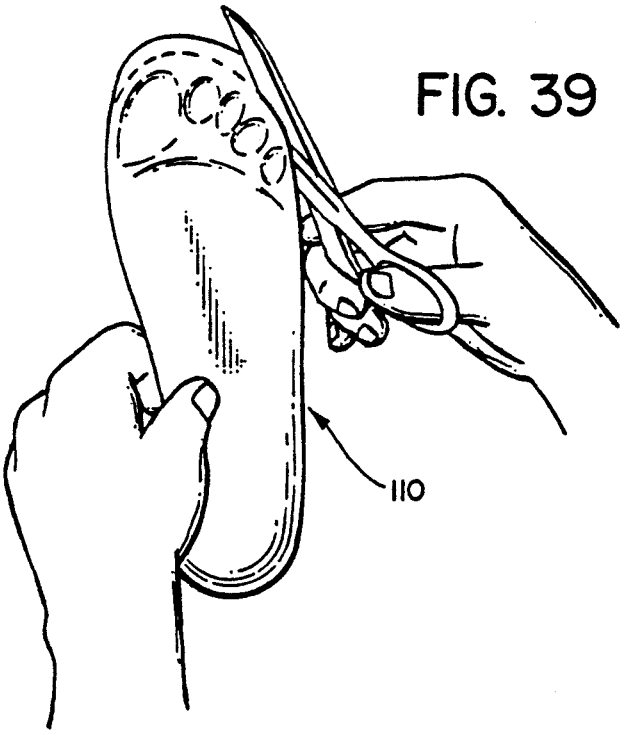

Then, as illustrated in FIGS. 37, 38 and 39, any excess cork which has been squeezed beyond the peripheral portions of the orthotic 110 can be trimmed away with a short knife (See FIG. 37) or by means of a scissors (See FIG. 38). Also, if trimming is needed to fit the orthotic 110 into the shoe or boot, the operator can use an outline from the shoe's insole to arrive at the correct shape. Then the orthotic can be trimmed back selectively, as shown in FIG. 39.

The orthotic 110 formed in the manner described above has the following characteristics. The side portions which are formed by the peripheral portions of the cap C and the cork insert 112 are relatively rigid, in comparison to the rest of the orthotic 110. That portion of the orthotic which is positioned between the side portions formed by the cap C and the U-shaped cork insert 112 (i.e. that portion of the orthotic 110 that is occupied by the pad portions 129*a* and 129*b*) is more readily bendable in a manner that the side portions of the rear half of the orthotic 110 can be bent downwardly and upwardly along a longitudinal center axis of the orthotic 110.

The effect of this is that when during the gate cycle there is initial heel contact, the normal tendency would be for the subcutaneous flesh at the bottom of the heel tends to expand and flatten outwardly. However, with the present invention, as the middle heel portion of the orthotic insert is deflected downwardly, the peripheral portions of the heel portion of the orthotic insert deflect slightly, but to a large extent resist such lateral expansion. Then, when the weight is being taken off the heel, the sides "cradle" the heel as the sides of the orthotic move upwardly and inwardly.

Then during the mid stance phase of the gate cycle, the weight of the person is exerted at a more forward location toward the mid foot. Again, as the longitudinal center portion of the orthotic is pressed downwardly, the side portions of the orthotic grip the side portions of the foot and thus provide support. Also, the cap C is contoured so that it is raised moderately at its midlength. Then, when weight is placed on the orthotic 110, it is able to elongate slightly as it is depressed.

As the person progresses further through the gate cycle so that the weight is transferred to the forward portion of the foot, the forward portion 129*c* of the pad 129 provides a resilient cushion for the person as he or she raises up on the ball of the foot. Further, as the person's weight is shifted to the ball of the foot, the resiliency of the pad portion 129 gives a certain lift to the heel and midportion of the person's foot. Then, as the person continues through that portion of the gait cycle so as to be pushing off from the ball of the foot, the resilience of the forward portion 129*c* of the pad 129 gives a certain amount of lift as the foot is moving out of ground contact.

The pad 129 and the blank B are characterized, relative to one another, in that the pad 129 is capable of resiliently deflecting to a greater degree than the blank B. By positioning the pad 129 in a longitudinal center portion of the blank B, not only is greater resilience added to the orthotic 110 in the area of the pad 129, but greater flexibility is added to the orthotic 110 at the longitudinal centerline portion occupied by the portion 129. Thus, the pad 129 absorbs shock, permits greater deformation of the orthotic 110 to "cradle" the side portions of the foot during ground contact, and also provides a certain amount of rebound as the person's foot is moving out of ground contact.

Other features of the present invention will become apparent from the following detailed description.

I claim:

1. A substantially unitary orthotic adapted to be placed in an article of footwear for use with a foot as said foot goes through a gait cycle, said orthotic having a longitudinal center axis parallel to a lengthwise portion of said foot, a front portion, a rear portion, and two side portions, said orthotic comprising:

a. an upper blank portion configured to extend laterally across a plantar area of said foot and to extend longitudinally from a heel portion of said foot to at least a metatarsal head area of said foot;

b. said blank portion having a longitudinally extending zone of disparate resiliency relative to first and second side areas of said blank which are adjacent to first and second sides of said zone of disparate resiliency, said zone of disparate resiliency extending longitudinally from a rearward end configured to be located beneath said heel portion of said foot to a forward end configured to be located approximately beneath said metatarsal head area of said foot;

b. said longitudinally extending zone of disparate resiliency being configured to deform under said foot to a greater extent than said first and second side areas as said foot begins to bear weight following heel strike, so that as said foot transitions from heel strike to mid-gait and a center of pressure under said foot transitions from said heel portion of said foot to said metatarsal head area, said zone of disparate resiliency deforms downwardly relative to said side areas so that said orthotic flexes about said longitudinal axis, and said side areas cradle said foot generally along said longitudinal axis and urge said foot into a predetermined neutral position so as to assist said foot in progressing from a mobile adaptor to a rigid lever for a subsequent propulsion phase of said gait cycle.

2. The orthotic of claim 1, wherein said zone of disparate resiliency comprises a longitudinally-extending recess formed in a bottom surface of said blank.

3. The orthotic of claim 2, further comprising a complementally-formed, shock-absorbing resilient pad dimensioned to fit within said recess.

4. The orthotic of claim 3, wherein said recess flares laterally outwardly at said forward end.

5. The orthotic of claim 4, wherein said resilient pad has an outwardly-flared forward end which is dimensioned to fit within said outwardly-flared forward end of said recess so as to absorb shock beneath said metatarsal head area of said foot.

6. The orthotic of claim 3, further comprising a horseshoe-shaped insert positioned on said bottom side of said blank and extending around said rearward end of said orthotic and along said sides of said zone of disparate resiliency so as to augment said zone of disparate resiliency.

7. The orthotic of claim 6, wherein said horseshoe-shaped insert is an insert of thermoformable cork resin material.

8. The orthotic of claim 7, wherein said horseshoe-shaped insert of thermoformable cork resin material is configured to be deformable after heating by being subjected to pressure against said plantar surface of said foot when said foot is locked as a rigid lever in a neutral position, so that said pad is permanently deformed by said pressure and after setting cooperates with said zone of disparate resiliency to urge said foot towards said neutral position as said foot transitions from heel strike to mid-gait.

9. The orthotic of claim 1, further comprising a lower, relatively rigid cap portion positioned below said blank portion and configured to extend from said heel portion of said foot to a location rearwardly of said metatarsal area of said foot, and also extending laterally across said plantar area, said cap having upwardly extending side walls along at least said side portions of said orthotic.

10. The orthotic of claim 9, wherein said zone of disparate resiliency further comprises a longitudinally-extending recess formed in a bottom surface of said relatively rigid cap portion so that said cap portion is relatively weakened at said recess so that said cap portion flexes about said longitudinal axis so as to further urge said foot into said neutral position as said foot transitions from heel strike to mid-gait.

11. The orthotic of claim 9, further comprising a horseshoe-shaped insert positioned intermediate said blank and said cap portion and extending around said rearward end of said orthotic and along said sides of said zone of disparate resiliency so as to augment said zone of disparate resiliency.

12. The orthotic of claim 11, wherein said horseshoe-shaped insert is an insert of thermoformable cork resin material, and said relatively rigid cap portion has at least one perforation therethrough, said cork resin pad and said cap portion being configured so that after heating said insert is deformable by said insert and said cap being subjected to pressure against said plantar surface of said foot when said foot is locked as a rigid lever in a neutral position, so that said insert is permanently deformed by said pressure and after setting cooperates with said zone of disparate resiliency to urge said foot towards said neutral position as said foot transitions from heel strike to mid-gait, and so that said thermoformable cork resin material of said horseshoe-shaped insert extrudes through said at least one perforation in said cap portion so as to bond said cap portion to said insert after setting.

13. A substantially unitary orthotic adapted to be placed in an article of footwear for use with a foot as said foot goes through a gait cycle, said orthotic having a longitudinal center axis parallel to a lengthwise portion of said foot, a front portion, a rear portion, and two side portions, said orthotic comprising:

a. an upper, relatively flexible blank portion configured to extend laterally across a plantar area of said foot and to extend longitudinally from a heel portion of said foot to at least a metatarsal head area of said foot, said blank portion having a longitudinally extending recess formed in a bottom surface thereof so as to provide a zone of disparate resiliency relative to first and second side areas of said blank which are adjacent first and second side of said longitudinally-extending recess, said zone of disparate resiliency being configured to deform under said foot to a greater extent than said side areas of said blank as said foot begins to bear weight, so that as said foot transitions from heel strike to mid-gait said zone of disparate resiliency deforms downwardly relative to said side areas of said blank so that said orthotic flexes about said longitudinal axis and said side areas of said blank cradle said foot and urge said foot into a predetermined neutral position so as to assist said foot in progressing from a mobile adaptor to a rigid lever for a subsequent propulsion phase of said gait cycle;

b. a lower, relatively rigid cap portion positioned below said blank portion and configured to extend from said heel portion of said foot to a location rearwardly of said metatarsal head area of said foot, and also extending laterally across said plantar area, said cap having upwardly extending side walls along at least said side portions of said orthotic; and c. a horseshoe-shaped insert positioned intermediate said blank and said cap and extending around a rearward end of said orthotic and along said side areas of said longitudinally-extending recess so that said horseshoe-shaped insert cooperates with said zone of disparate resiliency to urge said foot towards said neutral position as said foot transitions from heel-strike to mid-gait.

14. A substantially unitary orthotic appliance adapted to engage a plantar surface of a foot, said orthotic comprising:

a. an upper black having an upper surface configured to generally follow the contour of said plantar surface of said foot and a recess formed in a bottom surface of said blank so as to form a zone of disparate resiliency relative to areas adjacent said zone;

b. a resilient pad received in said recess on said bottom surface of said blank for modifying said zone of disparate resiliency, said resilient pad having a somewhat bulbous calcaneal area, a narrowed portion forward of said calcaneal area, and an outwardly flared and forwardly extending padded area configured to be positioned adjacent to and beyond the metatarsal head area of said foot to adjacent the toes of said foot;

c. a horseshoe-shaped moldable insert disposed adjacent a rearward end of said resilient pad which is in said recess so that said orthotic appliance and along first and second sides of said pad; and d. a lower cap underlying said resilient pad and said moldable insert, said cap, insert, pad, and blank being fused together to form said unitary orthotic appliance.

15. The orthotic appliance of claim 14, wherein said lower cap extends from a rearward end at said rearward end of said orthotic appliance to a forward end proximate said metatarsal head area of said foot, and said resilient pad extends forwardly of said forward end of said cap.

* * * * *